US005687819A

United States Patent [19]

Lodge et al.

[11] Patent Number: 5,687,819

[45] Date of Patent: Nov. 18, 1997

[54] PORTFOLIO WITH SLIDING ORGANIZER PANEL

[75] Inventors: Glenn R. Lodge, O'Fallon; Lynne Johnson, St. Louis, both of Mo.

[73] Assignee: American Trading and Production Corporation, Baltimore, Md.

[21] Appl. No.: 506,552

[22] Filed: Jul. 25, 1995

[51] Int. Cl.[6] ..... A45C 3/02

[52] U.S. Cl. ..... 190/109; 190/111; 150/116

[58] Field of Search ..... 190/109, 110, 190/101, 102, 111; 150/148, 116, 152; 312/183, 193; 40/374, 375

[56] References Cited

U.S. PATENT DOCUMENTS

| | | | |
|---|---|---|---|
| 2,107,201 | 2/1938 | Krupp | 150/116 |
| 2,306,128 | 12/1942 | Katz | 150/116 |
| 2,877,505 | 3/1959 | Stephens | 220/8 X |
| 3,557,853 | 1/1971 | Jones | 383/86 |
| 4,262,838 | 4/1981 | Mackenzie | 229/125.23 X |
| 4,871,066 | 10/1989 | LaWall | 190/110 X |

FOREIGN PATENT DOCUMENTS

| | | | |
|---|---|---|---|
| 330717 | 3/1903 | France | 190/109 |

*Primary Examiner*—Allan N. Shoap
*Assistant Examiner*—Niki M. Kopsidas
*Attorney, Agent, or Firm*—Cohn, Powell & Hind

[57] ABSTRACT

This portfolio (10) includes a fixed panel (14) and a sliding panel (12), with at least one storage area (16), and an attachment (18) between the sliding panel (12) and the fixed panel (14) to permit the sliding panel (12) to be moved outwardly from a retracted position to an extended position relative to said fixed panel (14) yet remain attached to the fixed panel (14) so that articles can be organized, stored and carried on the panel (12) in the portfolio (10) in the retracted position. The storage areas (16) may include self-closing pockets (40–46) that shut automatically when the sliding panel is retracted.

8 Claims, 2 Drawing Sheets

PORTFOLIO WITH SLIDING ORGANIZER PANEL

BACKGROUND OF THE INVENTION

This invention relates generally to a portfolio or business case and more particularly to a portfolio or business case having a sliding panel with storage areas.

There are several means of storing articles within a portfolio or business case, the most common probably being to merely place the articles at random in the case thereby allowing them to slide around. The user must hunt for items within the portfolio and the articles may be damaged from sliding around. Another means of carrying articles in a portfolio is to put them into some sort of container before the container is then put into the portfolio. For example, glasses may be put into a glasses' case, pens and pencils put into a pouch, or business cards put into a card carrier and then the glasses' case, pouch and card carrier are placed in the portfolio. This method protects the items from damage, but it causes even more wasted space within the portfolio. A third common practice is to place articles into pockets that are sewn into one of the internal partitions of the portfolio. Since the partition is fixed, the user must look into the portfolio and reach into the portfolio among the contents to find an article. This is especially difficult when the portfolio is full.

If the user does not want the articles loose within the portfolio, the user may be forced to instead carry these items separately by placing glasses, pens, pencils and business cards within the user's pockets. All of these methods provide for transporting items but suffer from the disadvantage that the user may have damaged articles, wasted space in the portfolio or have the user's pockets stuffed with articles. Alternatively, the user must dig through the portfolio in search of an article that is loose within it.

The present system overcomes these and other problems in a manner not revealed in the known prior art.

SUMMARY OF THE INVENTION

This invention provides a portfolio or business case with a sliding panel which can be readily accessed for storing, organizing and carrying articles such as glasses, calculators, pens, pencils and business cards.

It is an aspect of this invention to provide a portfolio assembly, comprising a fixed panel, a sliding panel including at least one storage means and an attachment means between said sliding panel and said fixed panel to permit said sliding panel to be moved outwardly from a retracted position relative to said fixed panel yet remain attached to said fixed panel.

It is another aspect of this invention to provide that said attachment means includes slot means in one of said panels, and means attached to the other of said panels and extending through said slot means to permit relative movement between said slot means and said means extending through said slot means.

It is still another aspect of this invention to provide that said slot means is disposed in said fixed panel.

Another aspect of this invention is to provide that said slot means includes a pair of substantially vertical slots, each with an offset upper holding portion.

It is another aspect of this invention to provide that said sliding panel includes opposed panel portions disposed on opposite sides of said fixed panel.

It is yet another aspect of this invention to provide that said means extending through said slot means is attached to each of said opposed panel portions.

It is an aspect of this invention to provide that said means extending through said slot means includes a substantially rigid element attached at each end to an associated panel portion.

Another aspect of this invention is to provide that the portfolio includes a front panel and a rear panel and said fixed panel is disposed in parallel relation between said front panel and said rear panel.

It is an aspect of this invention to provide that said storage means includes at least one pocket; and said pocket includes a front portion having a lower portion operatively attached to said sliding panel and an upper closure portion extending upwardly from said lower portion, said pocket including an attachment means releasably attaching said closure portion to said sliding panel.

It is another aspect of this invention to provide that said pocket lower portion and said closure portion are unitarily formed of relatively stiff material, and said pocket is disposed outwardly in the vicinity of the juncture of the lower and closure portions.

It is yet another aspect of said invention that said pocket includes pleated side portions connecting said front portion to said sliding panel; and said attachment means includes a hook and loop fastener means on said flap closure portion and on said sliding panel so that said flap closure portion is automatically closed by operative engagement with another portion of said portfolio as said sliding panel is pushed downwardly into the retracted position.

This portfolio having a sliding panel is inexpensive to manufacture, simple to use and efficient in operation.

DESCRIPTION OF THE PREFERRED EMBODIMENT

Figure 1:
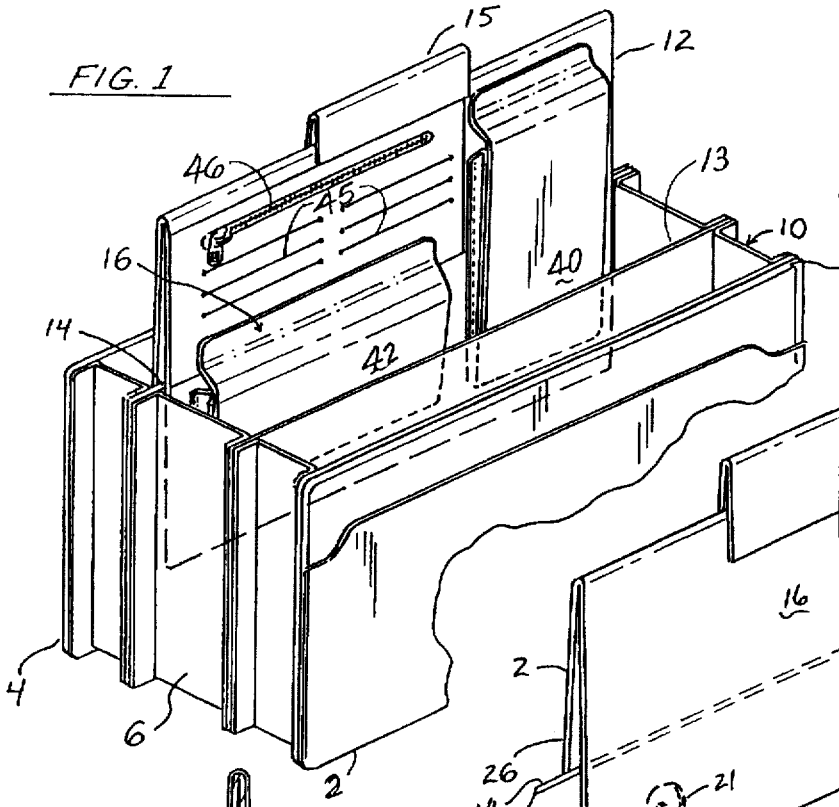
FIG. 1 is a perspective view of a portfolio having a sliding panel.
Figure 2:
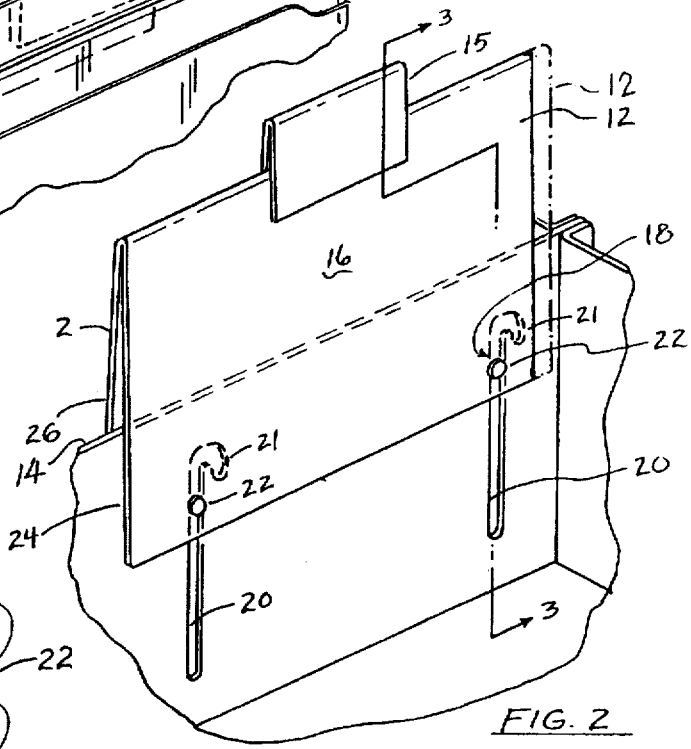
FIG. 2 is an enlarged fragmentary perspective view showing a sliding panel in the extended position, with details omitted.

Referring now by reference numerals to the drawings and first to FIGS. 1 and 2, it will be understood that the portfolio 10, includes a sliding panel 12 for storing articles thereon for easy access.

The portfolio 10 includes front and rear panels 2 and 4, side panels 6, bottom panel 8 and a plurality of intermediate panels 13 and 14 separating the business case 10 into compartments. One intermediate panel, panel 14 in the embodiment shown, provides a fixed means to which the sliding panel 12 is attached in removable relation. The sliding panel 12, which may have a pull tab 15, includes means providing at least one storage area 16 which can be used for holding various articles such as reading glasses, a calculator or business cards. The storage area 16 includes at least one pocket 40 which can be automatically closed when the sliding panel 12 is pushed back in the business case 10 as will be discussed in greater detail below. Also, the storage areas 16 can be located on one or both sides of the sliding panel.

An attachment means 18 is located between the sliding panel 12 and the fixed panel 14 to permit the sliding panel to be moved outwardly relative to the fixed panel 14, yet remain attached to the fixed panel. The attachment means 18 includes a holding means whereby the sliding panel is held in the outward position while the user is accessing the storage area 16. The user can store and carry articles on the storage areas 16 with the sliding panel 12 in a retracted position.

Figure 4:
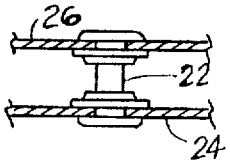
FIG. 4 is an enlarged cross-sectional view taken on line 4—4 of FIG. 3.
Figure 3:
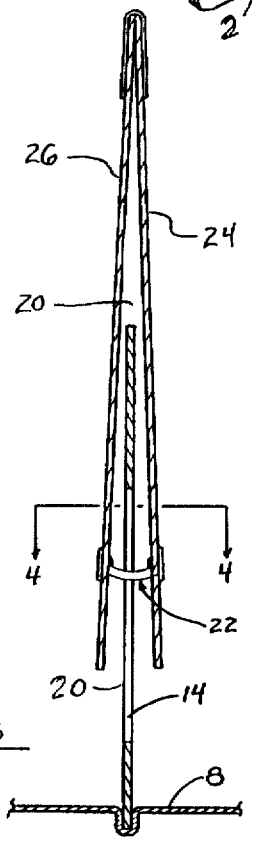
FIG. 3 is an enlarged cross-sectional view of a sliding panel taken on line 3—3 of FIG. 2.
Figure 6:
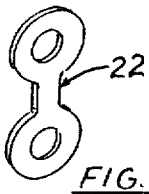
FIG. 6 is an enlarged perspective view of the attachment element.
Figure 5:
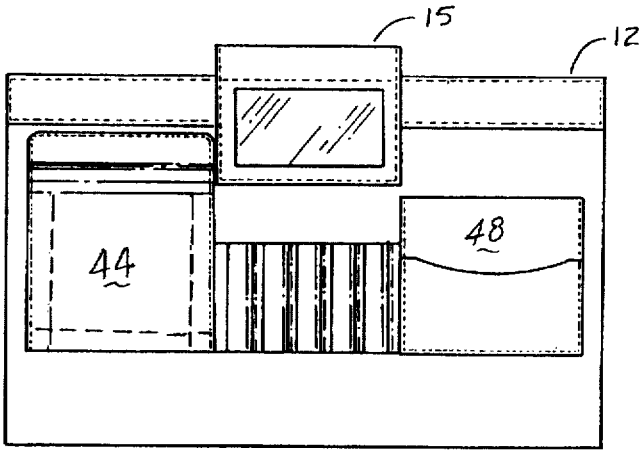
FIG. 5 is a rear elevational view of the sliding panel.

In the preferred embodiment shown in FIGS. 2 and 3, the sliding panel 12 with opposed panel portions 24 and 26 is disposed on opposite sides of the fixed panel 14 which constitutes a fixed means. The sliding panel attachment means 18 includes a pair of slots 20 in one of said panels, fixed panel 14 in the embodiment shown, and means in the form of a pair of associated elements 22 attached to the said other panel and extending through said slot means 20 to permit relative movement between said slots 20 and said elements 22 extending through said slots. The slots 20 may include an offset portion at the upper end with means 22 attached to each of the panel portions 24 and 26 such as shown in FIG. 2 where the slots 20 are substantially vertical with a curved top portion 21 which provides a means for holding the sliding panel 12 in the extended position when the sliding panel 12 is shifted transversely as shown in phantom outline. The elements 22 attached to the panels may be permanently affixed, for example riveted to the panel, or temporarily affixed, for example a cufflink arrangement (not shown). The elements 22 can be a cylindrical pin extending between and riveted to both of the opposed panels or a flexible strip of leather, plastic or the like, which can be attached in various ways such as sewn to panel 24 and riveted to panel 26. In FIGS. 3 and 4, the elements 22 are riveted in permanent or snapped relation to each of the opposed panel portions 24 and 26.

In FIG. 2, the slots 20 are shown disposed in said fixed panel 14 at different elevations. The fixed means providing a base for the sliding panel 12 could be any of the longitudinal panels in the business case 10 or the fixed means could be any of the transverse panels in the business case forming the fixed or flexible sides of the business case.

It will be understood that, in the embodiment shown, the storage area 16 is provided on both the front and rear of the panel 12. For example, on the front of the panel, as shown in FIG. 1, fairly deep pouches or pockets 40 and 42 are provided of various sizes suitable for storing eyeglasses, pocket calculators or the like; slits 45 for storing business cards and a zippered pocket 46 for storing valuables. On the rear of the panel another deep pocket 44 may be provided together with narrow open-ended pockets 47, suitable for pens and pencils; and a flat pocket 48 suitable for computer discs.

In the embodiment shown, the deep pockets 40, 42 and 44 are self closing as will now be described by reference to pocket 40.

Figure 7:
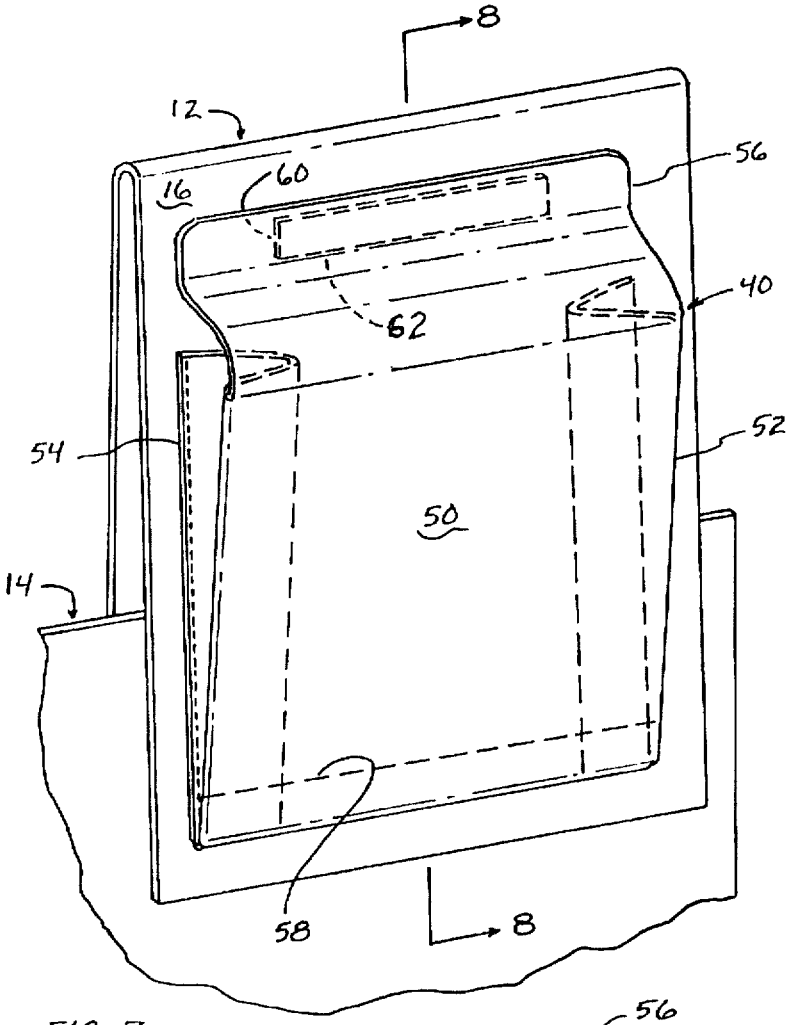
FIG. 7 is an enlarged fragmentary perspective view showing a typical pocket.
Figure 8:
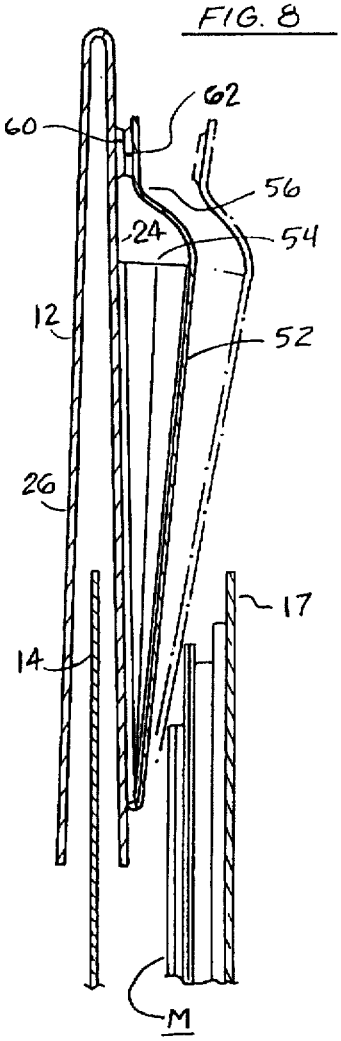
FIG. 8 is a cross-sectional view taken on line 8—8 of FIG. 7.
Figure 9:
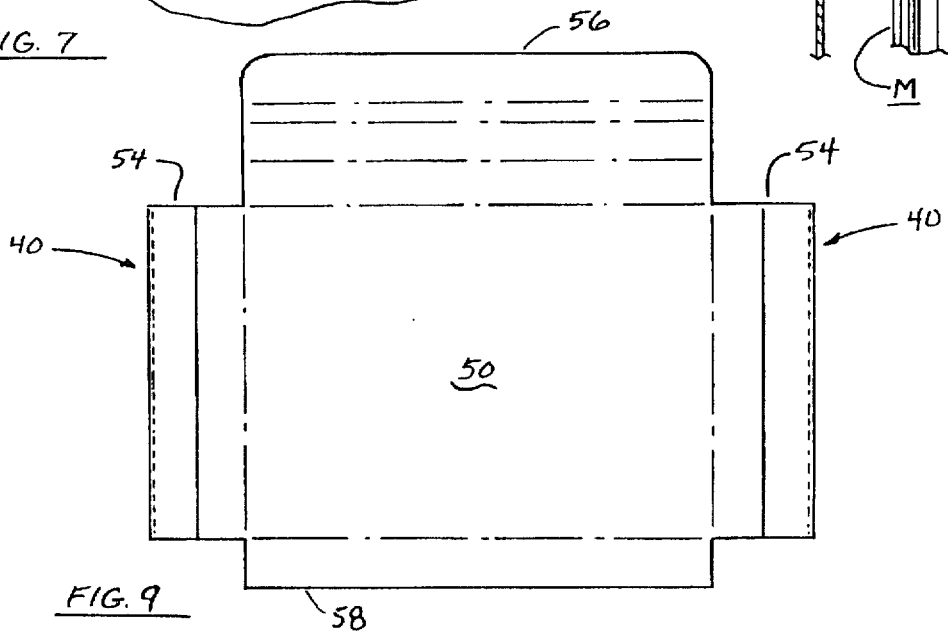
FIG. 9 is a developed view of said typical pocket.

The structural arrangement of the pocket 40, which is typical, is best shown by reference to FIGS. 7–9. As shown, pocket 40 includes a relatively stiff front portion 50 having a lower portion 52 attached, as by stitching, to the sliding panel 12 at the unitarily formed folded bottom end 58 and also attached at the sides by unitarily formed pleated gussets 54, as by stitching. The front panel 50 includes an upwardly extending closure flap portion 56, which is unitarily formed with the lower portion 52 in the embodiment shown. The closure flap portion 56 is provided on its rear face with a strip 62 of hook and loop fastener means, such as Velcro, which cooperates with a mating strip 60 on the sliding panel 12. The configuration and stiffness of the front panel 50 is such that the pocket is disposed outwardly in the vicinity of the juncture of the lower portion 52 and the closure portion 56. Accordingly, when the sliding panel is pushed downwardly into its retracted position against material stored in the case, such as papers or the like indicated by M, adjacent panel 17, the flap portion 56 is automatically pushed inward toward the sliding panel 12 from the open position shown in phantom outline in FIG. 8 and is thereby automatically self-closing. Alternatively, the panel 17 may be located sufficiently close to the panel 14 to produce the same wedging effect to close the flap.

In view of the above, it will be seen that various aspects and features of the invention are achieved and other advantageous results attained. While preferred embodiments of the invention have been shown and described, it will be obvious to those skilled in the art that changes and modifications may be made therein without departing from the invention in its broader aspects.

We claim as our invention:

1. A portfolio assembly comprising:

(a) a fixed panel;

(b) a sliding panel including at least one storage means;

(c) attachment means between said sliding panel and said fixed panel to permit said sliding panel to be moved from a retracted position outwardly relative to said fixed panel yet remain attached to said fixed panel;

(d) said attachment means including a slot in one of said panels, and means attached to the other of said panels and extending through said slot to permit relative movement between said slot and said means extending through said slot;

(e) said slot being disposed in said fixed panel; and (f) said slot provided with an offset upper holding portion.

2. A portfolio assembly comprising:

(a) a fixed panel;

(b) a sliding panel including at least one storage means;

(c) attachment means between said sliding panel and said fixed panel to permit said sliding panel to be moved from a retracted position outwardly relative to said fixed panel yet remain attached to said fixed panel;

(d) said attachment means includes a slot in one of said panels, and means attached to the other of said panels and extending through said slot to permit relative movement between said slot and said means extending through said slot; and (e) said sliding panel including opposed panel portions disposed on opposite sides of said fixed panel.

3. A portfolio as defined in claim 2, in which:

(f) said slot is provided in said fixed panel; and (g) said means extending through said slot is attached to each of said opposed panel portions.

4. A portfolio as defined in claim 3, in which:

(h) said means extending through said slot includes a substantially rigid element attached at each end to an associated panel portion.

5. A portfolio assembly comprising:

(a) a fixed panel;

(b) a sliding panel including at least one storage means;

(c) attachment means between said sliding panel and said fixed panel to permit said sliding panel to be moved from a retracted position outwardly relative to said fixed panel yet remain attached to said fixed panel;

(d) said portfolio including a front panel and a rear panel; and (e) said fixed panel being disposed in substantially parallel relation between said front panel and said rear panel.

6. A portfolio assembly comprising:

(a) a fixed panel;

(b) a sliding panel disposed within said portfolio and including at least one storage means;

(c) attachment means between said sliding panel and said fixed panel to permit said sliding panel to be moved from a retracted position outwardly relative to said fixed panel yet remain attached to said fixed panel;

(d) said storage means including at least one pocket; and (e) said pocket including a front portion having a lower portion operatively attached to said sliding panel and an upper closure portion extending upwardly from said lower portion, said pocket including a pocket attachment means releasably attaching said closure portion to said sliding panel.

7. A portfolio, as defined in claim 6, in which:

(f) said pocket lower portion and said closure portion are unitarily formed of relatively stiff material, and said pocket is disposed outwardly in the vicinity of the junction of the lower and closure portions.

8. A portfolio as defined in claim 7, in which:

(g) said pocket includes pleated side portions connecting said front portion to said sliding panel; and (h) said pocket attachment means includes a hook and loop fastener means on said flap closure portion and on said sliding panel so that said flap closure portion is automatically closed by operative engagement with another portion of said portfolio as said sliding panel is pushed downwardly into the retracted position.

* * * * *